US012359388B2

(12) United States Patent
Kaufman et al.

(10) Patent No.: US 12,359,388 B2
(45) Date of Patent: Jul. 15, 2025

(54) TAPERED, LOCKING, ANTI-REVERSE COUPLER ASSEMBLY FOR FOUNDATION SUPPORT SYSTEM

(71) Applicant: PIER TECH SYSTEMS, LLC, Chesterfield, MO (US)

(72) Inventors: Kevin Kaufman, Des Peres, MO (US); Michael D. Wilkis, Ellisville, MO (US)

(73) Assignee: Pier Tech Systems, LLC, Chesterfield, MO (US)

( * ) Notice: Subject to any disclaimer, the term of this patent is extended or adjusted under 35 U.S.C. 154(b) by 124 days.

(21) Appl. No.: 18/351,607

(22) Filed: Jul. 13, 2023

(65) Prior Publication Data

US 2024/0026627 A1 Jan. 25, 2024

Related U.S. Application Data

(60) Provisional application No. 63/390,320, filed on Jul. 19, 2022.

(51) Int. Cl.

| | |
|---|---|
| ***E02D 5/52*** | (2006.01) |
| ***E02D 5/28*** | (2006.01) |
| ***E02D 5/56*** | (2006.01) |

(52) U.S. Cl.

CPC ..... *E02D 5/526* (2013.01); *E02D 5/56* (2013.01); *E02D 2300/0029* (2013.01); *E02D 2600/20* (2013.01)

(58) Field of Classification Search

CPC .. E02D 5/526; E02D 5/56; E02D 7/22; E02D 2600/20; E02D 5/285; E02D 7/12

See application file for complete search history.

(56) References Cited

U.S. PATENT DOCUMENTS

| | | | | |
|---|---|---|---|---|
| 6,183,167 | B1 * | 2/2001 | Ruiz | F16B 7/042 405/253 |
| 7,220,081 | B1 | 5/2007 | Gantt, Jr. | |
| 2008/0170912 | A1 | 7/2008 | Kaufman | |
| 2014/0196955 | A1 * | 7/2014 | Queen | E21B 10/44 175/57 |
| 2015/0071712 | A1 * | 3/2015 | Kemp | E02D 5/56 405/251 |
| 2016/0281432 | A1 * | 9/2016 | Queen | E02D 5/56 |
| 2019/0127940 | A1 * | 5/2019 | Kaufman | E02D 5/56 |
| 2021/0017728 | A1 * | 1/2021 | Dekle | E02D 5/34 |
| 2021/0254298 | A1 | 8/2021 | Kaufman et al. | |

FOREIGN PATENT DOCUMENTS

| | | | |
|---|---|---|---|
| CA | 2295788 | A1 | 7/2000 |
| KR | 101784392 | B1 * | 10/2017 |

OTHER PUBLICATIONS

European Search Report issued for Application No. EP23185823.4, dated Dec. 13, 2023 (9 pages).

* cited by examiner

*Primary Examiner* — Benjamin F Fiorello
*Assistant Examiner* — Stacy N Lawson
(74) *Attorney, Agent, or Firm* — Armstrong Teasdale LLP

(57) ABSTRACT

A coupled shaft assembly for a foundation support system includes conical-shaped inner and outer couplers with mating helical ribs and grooves, and an anti-reverse element extending through different shaped openings in the inner and outer couplers that accommodates a limited degree of relative rotation of the couplers and thereafter precludes further relative rotation and an undesirable disengagement of the inner and outer couplers when subjected to reverse rotation.

32 Claims, 11 Drawing Sheets

STATE OF THE ART

STATE OF THE ART

STATE OF THE ART

TAPERED, LOCKING, ANTI-REVERSE COUPLER ASSEMBLY FOR FOUNDATION SUPPORT SYSTEM

CROSS-REFERENCE TO RELATED APPLICATIONS

This application claims the benefit of U.S. Provisional Application Ser. No. 63/390,320 filed Jul. 19, 2022, the complete disclosure of which is hereby incorporated by reference in its entirety.

This application further relates in part to subject matter disclosed in U.S. application Ser. No. 17/174,805 filed Feb. 12, 2021, which claims the benefit of U.S. Provisional Application Ser. No. 62/976,442 filed Feb. 14, 2020, the entire disclosures of which are hereby incorporated by reference in their entirety.

BACKGROUND OF THE INVENTION

The field of the invention relates generally to building foundation support systems including assemblies of coupled structural support shaft components, and more specifically to improved mechanical torque transmitting couplings for foundation support shaft components such as helical piers.

If a building foundation moves or settles in the course of construction, or at any time after construction is completed, such movement or settlement may affect the integrity of the building structure and lead to costly repairs. While much care is taken to construct stable foundations in new building projects, certain soil types or other building site conditions, or certain types of buildings or structures, may present particular concerns that call for additional measures to ensure the stability of building foundations.

Helical piers, also known as anchors, piles or screwpiles, are deep foundation solutions commonly used when standard foundation solutions are problematic. Helical piers are driven into the ground with reduced installation time and little soil disturbance compared to large excavation work that may otherwise be required by standard foundation techniques, and a number of helical piers may be installed at designated locations on a construction site to transfer and distribute the weight of the building structure to load bearing soil to prevent the foundation from moving or shifting. Lifting elements, support brackets or load-bearing caps may be used in combination with the helical piers to construct various types of foundation support systems meeting different needs for both foundation repair and new construction applications.

While known foundation support systems are satisfactory in many aspects, improvements are nonetheless desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

In order to understand the inventive concepts described herein to their fullest extent, some discussion of the state of the art and certain problems and disadvantages that exist in the art is set forth below, followed by exemplary embodiments of improved foundation support systems and components therefore which overcome such problems and disadvantages in the art.

Figure 1:
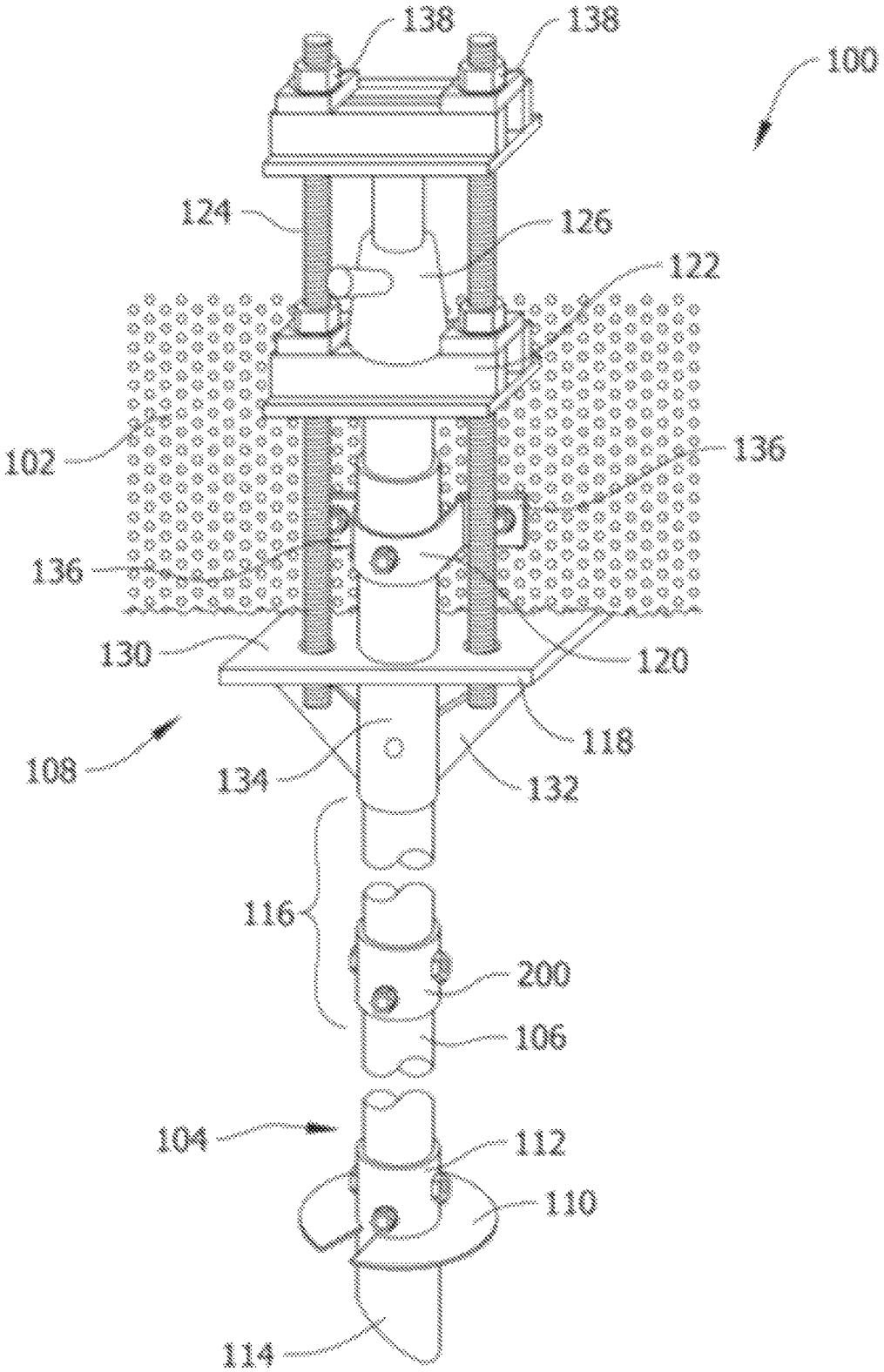
FIG. 1 is a perspective view of a conventional foundation support system interacting with a building structure.

FIG. 1 illustrates a perspective view of a conventional foundation support system 100 in combination with a building foundation 102 which in turn supports a structure in a residential, commercial or industrial construction site. The structure being supported by the building foundation 102 may include various types of buildings, homes, edifices, etc. in real estate developments and improvements. The foundation support system 100 may be applied in the new construction of the building foundation 102 prior to the structure being completed, or may alternatively be applied for maintenance and repair purposes in a retrofit manner to a pre-existing building foundation at any desired time after the foundation 102 and building structure are initially constructed. While exemplary structures are mentioned above, the foundation support system 100 may be used in a similar manner to provide foundation support for various different types of structures and to securely support anticipated structural loads without more extensive excavation that standard building foundations otherwise require to provide a similar degree of support. The foundation support system described and illustrated herein is therefore a non-limiting example of the type of system that may be benefit from the inventive concepts described further below.

Primary piles or pipe shafts (hereinafter collectively referred to as a "pile" or "piles") 104 of appropriate size and dimension may be selected and may be driven into the ground or earth at a location proximate or near the foundation 102 using known methods and techniques. The size of the primary pile 104 and the insertion depth needed to provide the desired support may be determined according to known engineering methodology and analysis of the construction site and the particular structure that is to be supported. The primary piles 104 typically consist of a long shaft 106 that is driven into the ground to the desired depth, and a support element such as a plate or bracket (not shown) or a lifting element such as a lifting assembly 108 may be assembled to the shaft 106 proximate the foundation 102. The shaft 106 of the primary pile 104 may also include one or more lateral projections such as a helical auger 110. Such helical steel piles 104 are available from, for example, Pier Tech Systems (www.piertech.com) of Chesterfield, Missouri.

The helical auger 110 may in some embodiments be separately provided from the piling 104 and attached to the piling 104 by welding to a sleeve 112 including the auger 110 provided as a modular element fitting. As such, the sleeve 112 of the modular fitting may be slidably inserted over an end of the shaft 106 of the piling shaft 104 and secured into place with fasteners such as bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 which may be allthread rods, for example, and accompanying hardware. In another suitable embodiment the lifting assembly 108 may also include a jack 126 and a jacking block 128. Suitable lifting assemblies may correspond to those available from Pier Tech Systems (www.piertech.com) of Chesterfield, Missouri, including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned to accommodate one of the primary pile 104 or an extension pile 116. The housing 134 is generally perpendicular to the surface of lift plate 130 and extends above and below the plane of lift plate 130.

In the example shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the example shown, the bracket clamps 120 include a generally Ω-shaped piece having a center hole at the apex of the "Ω" to accommodate a fastener. The Ω-shaped bracket clamp 120 includes ends 136, extending laterally, that include openings to accommodate fasteners. The fasteners extending through the openings in the ends 136 are attached to the foundation 102, while the fastener extending through the center opening at the apex of the "Ω" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternatively, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of Chesterfield, Missouri and other providers, any of which may be utilized in other embodiments of the foundation support system.

As mentioned, it is sometimes necessary to extend the length of a piling by connecting one or more shafts which in combination may provide support that extends deeper into the ground than the shafts individually can otherwise reach. For example, a first helical pier component, referred to as a primary pile, may be driven nearly fully into the ground at the desired location, and a connection component such as an extension pile may then be attached to the end of the primary pile in order to drive the primary pile deeper into the ground while supporting the building foundation at an end of the extension pile. More than one extension pile may be required depending on the lengths of the piles available and/or particular soil conditions.

Figure 2:
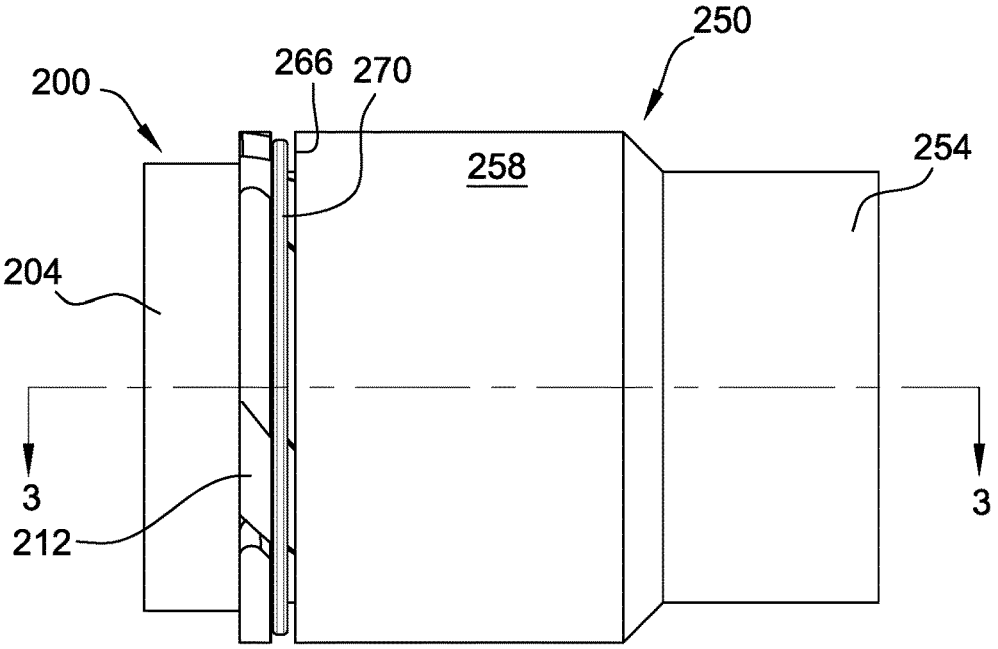
FIG. 2 is a side view of a conventional coupler and shaft assembly for the foundation support system shown in FIG. 1.
Figure 3:
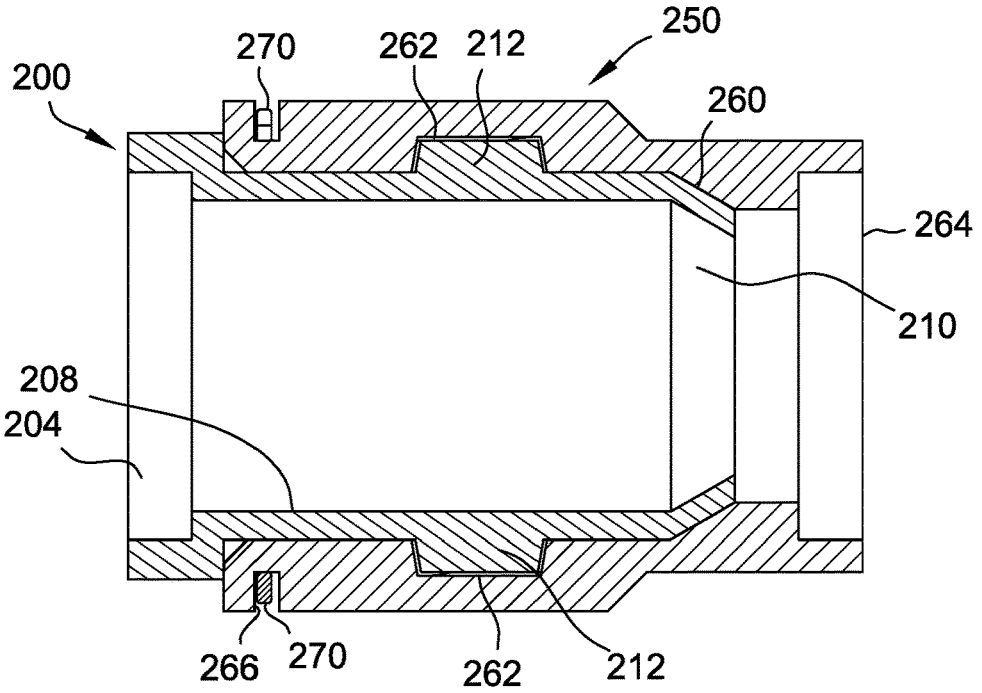
FIG. 3 is a cross sectional view of the mated components shown in FIG. 2.

FIGS. 2 and 3 are a side view and sectional view, respectively, of a coupler assembly that overcomes some of the drawbacks of prior couplers for foundation support systems such as that shown in FIG. 1. Specifically, FIGS. 2 and 3 illustrate a snap-lock coupler system in the form of couplers 200, 250 that advantageously avoid any need for separately provided fasteners such as bolts to interconnect shafts associated with each respective coupler 200, 250. The coupler 200 includes a shaft receiving end 204 for a first shaft, and the coupler 250 includes a shaft receiving end 254 for a second shaft. The shafts associated with each coupler 200, 250 may be, for example, primary piles and/or extension piles in the foundation support system. In lieu of bolts to maintain an engagement of the couplers 200, 250 an annular spring element 270 is provided on the coupler 250 that automatically operates with snap-action engagement to axially interlock the couplers 200, 250 to one another.

The coupler 250 is formed with a main body 258 defining a central passageway or bore having an inner surface with an inner diameter about equal to, but slightly larger than the outer diameter of a main body 208 of the coupler 200. The coupler 250 includes a circumferential retaining groove 266 formed in its outer surface adjacent a distal end of the coupler, and the annular spring retainer element 270 extends in the retaining groove 266.

The main body 208 of the coupler 200 is formed with a number of outwardly projecting spaced apart and helically extending ribs 212 that are mated with complementary helical grooves 262 formed on an inner surface of the main body 258 of the coupler 250. As the couplers 200, 250 are mated, the ribs 212 deflect the annular spring retainer element 270 to enlarge its diameter until the spring retainer element 270 resiliently snaps back to its original diameter. After snapping back to the original diameter, the spring retainer element 270 extends in a combination of the retaining groove 266 of the coupler 250 and an aligned retaining groove formed in the coupler 200.

By virtue of the snap-action engagement of the couplers 200, 250 the assembly of the couplers to make the desired interconnections of shafts is simplified, and issues associated with conventional separately provided fasteners such as bolts to make the desired interconnections of the shafts through the couplers is avoided. The spring retainer element 270 provides an axial interlock of the engaged couplers 200, 250 while the ribs and grooves simultaneously provide both axial and rotational interlock of the couplers 200, 250. Because the helical ribs 212 and grooves 262 distribute any uplift forces in the mated outer and inner surfaces of the couplers 200, 250, the spring retainer element 270 may be smaller and lighter than it otherwise may need to be if it exclusively bore all of the uplift forces that may be presented.

Further details of the snap-lock coupler system shown in FIGS. 2 and 3 are described in U.S. patent application Ser. No. 17/174,805, now published as U.S. Patent Application Publication No. 2021/0254298 of Pier Tech Systems, the teachings of which are incorporated by reference herein.

While the snap-lock couplers 200, 250 solve significant problems presented in conventional foundation support systems and work well in certain installations, the present inventors have realized certain limitations presented in the snap-lock couplers for certain end-use installations. Specifically, the mated helical ribs 212 and helical grooves 262 in the couplers 200, 250 were designed and intended to provide secure rotational interlock to transmit torque in either direction (forward or reverse) to drive a piling deeper into the ground or to partially or completely withdraw it from the ground, without requiring a separately fastener such as a bolt to complete the torque transmitting connection. While the inventors confirm that the mated helical ribs 212 and helical grooves 262 in the couplers 200, 250 do provide secure rotational interlock to transmit torque in a forward direction as a helical pile is being driven into the ground, when the coupler assembly is subjected to reverse rotation a relative rotation of the couplers 200, 250 is possible. That is, the expected rotational interlock of the couplers 200, 250 in reverse rotation is not necessarily present, and relative reverse rotation of the couplers 200, 250 with respect to one another may be problematic in some installations.

The inventors have observed an unexpected result in that the helical ribs 212 exhibit a tendency to back out of the helical grooves 262 when rotated in reverse. In other words, the helical ribs 212 are prone to moving longitudinally in the helical grooves 262 in a manner that the helical ribs 212, if not impeded, would axially withdrawal from the helical grooves 262 and realize separation of the couplers when the coupler assembly is subject to reverse rotation. The spring retainer element 270 operates to inhibit such withdrawal and associated separation of the couplers 200, 250 and instead maintain the ribs 212 fully engaged in the grooves 262. But this imposes an undesirable stress on the spring retainer element 270 that can compromise the connection between the couplers 200, 250 as reverse rotational force (i.e., torque) increases. In certain cases, torsional forces can rise to levels wherein the spring element 270 experiences shear stress to the point of failure, leaving the couplers 200, 250 effectively uncoupled in the axial direction. If uplift forces are also present in this state, the couplers 200, 250 can undesirably separate from one another in a manner that would defeat the integrity of the foundation support system. Considering that this may happen at a below ground location that may be difficult to detect, the building foundation may not be adequately supported despite the presence of the foundation support system.

Additionally, and apart from any reverse rotation that tends to withdraw the helical ribs 212 from the helical grooves 262 and separate the couplers 200, 252, similar dynamics can result when the coupler assembly is subjected to uplift forces that tend to pull the couplers 200, 250 apart. Initially the spring element 270 will operate to oppose the uplift forces and maintain engagement of the ribs 212 and grooves 260, but if uplift forces are sufficiently high, stress imposed on the spring element 270 may cause it to shear and effectively uncouple the couplers with potential to defeat the integrity of the foundation support system.

FIGS. 4-7 are various views of a coupled shaft assembly 300 for the foundation support system 100 shown in FIG. 1 in accordance with an exemplary embodiment of the present invention that beneficially overcomes the limitations of the snap-lock coupler system shown in FIGS. 2 and 3. Method aspects of the inventive couplers will be in part apparent and in part explicitly discussed in the following description.

The coupler assembly 300 in the example shown includes a first or outer coupler 302 provided on a first shaft 304 which may be an extension pile in a foundation support system such as that shown in FIG. 1. The coupler assembly 300 also includes a second or inner coupler 306 provided on a second shaft 308 which may be a primary pile in a foundation support system such as that shown in FIG. 1. Alternatively the shafts 304, 308 may each be extension piles in a foundation support system. It is recognized, however, the that shafts 304, 308 need not be primary or extension foundation support pile elements at all, and instead the couplers 302, 306 may be used in a wide variety of pipe or shaft systems that present similar problems and concerns to those discussed above or that may benefit from the coupling features described herein in another end use or application besides a foundation support system.

The couplers 302, 306 including the features illustrated and described further below may be separately manufactured from the shafts 304, 308 in certain embodiments, and thereafter attached to each shaft 304, 308 in a known manner, including but not necessarily limited to welding. Alternatively, the couplers 302, 306 may be integrally formed on respective ends of the shafts 304, 308 via casting, forging and swaging processes instead of separately provided and attached elements. The couplers 302, 306 and the shafts 304, 308 may each be fabricated from high strength steel or another suitable material according to known techniques.

The shafts 304, 308 connected through the couplers 302, 306 can be hollow or filled with a substance such as concrete, chemical grout, or another known suitable cementitious material or substance familiar to those in the art to enhance the structural strength and capacity of the shafts when used as foundation support pilings or in other end use applications. The pilings defined by the connected shafts 304, 308 may be prefilled with cementitious material in certain contemplated embodiments.

Likewise, in other contemplated embodiments, cementitious material, including but not necessarily limited to grout material familiar to those in the art, may be mixed into the soil around the piles as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the piles to direct a flow of cementitious material through the piles and at selected locations into the surrounding soil.

Unlike the couplers shown in FIGS. 2 and 3, there is no retainer spring element 270 in the coupled shaft assembly 300, and as such the potential issues associated with stressing and shearing of the spring element 270 are avoided in the coupled shaft assembly 300. A separately provided anti-reverse rotation element 330 in the form of a bolt extends through the couplers 302 and 306 to ensure that a problematic relative rotation and separation of the couplers 302, 306 will not occur if the shaft 304, for example, is subjected to reverse rotation in the installation of a foundation support system and/or if the shaft 304 is subjected to uplift forces in use. In the coupler assembly 300, and by virtue of the anti-reverse rotation element 330, rotational and uplift forces are borne between mating ribs and grooves formed in the couplers 302, 306 as further described below.

Figure 7:
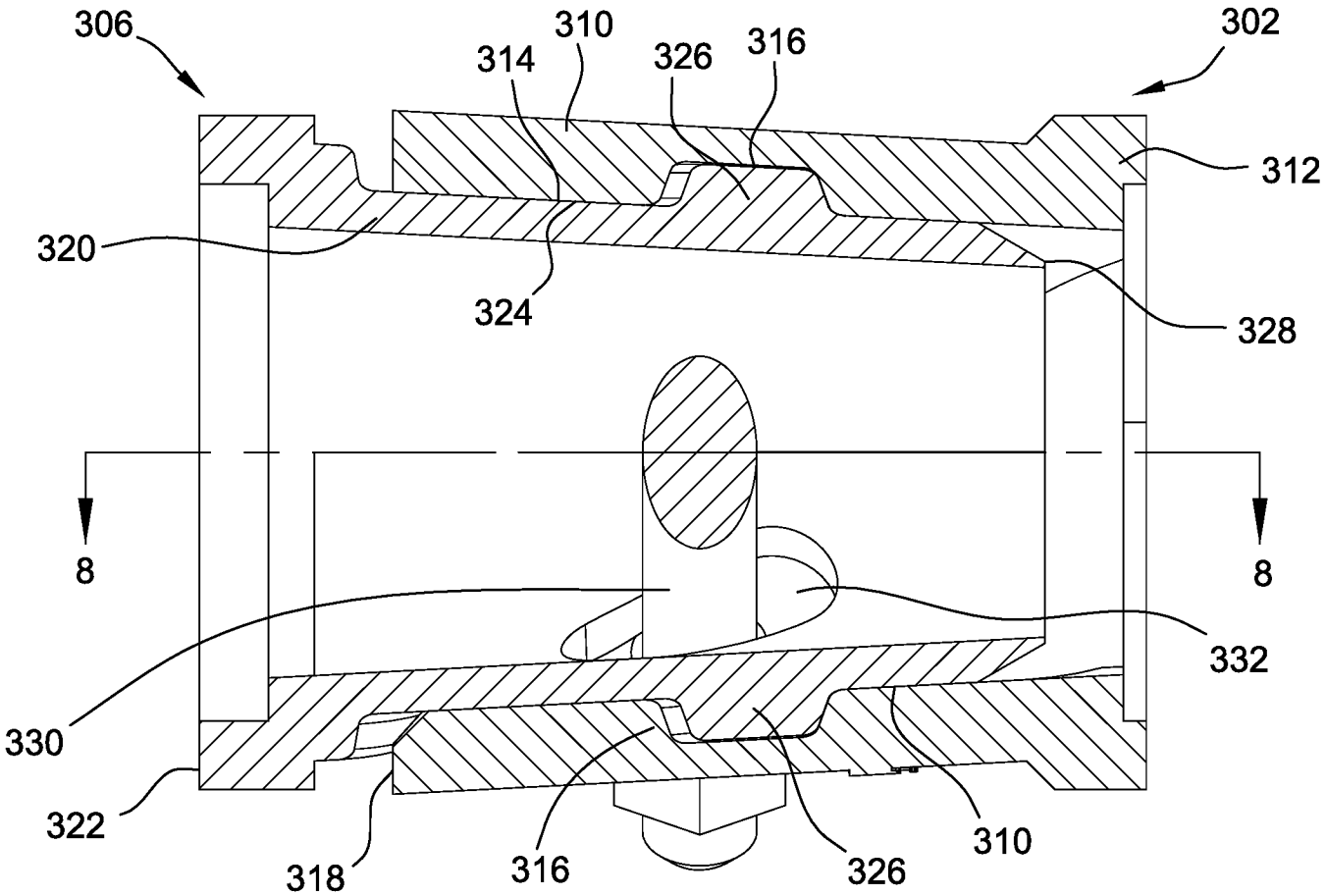
FIG. 7 is a first sectional view of the coupler assembly taken alone line 7-7 in FIG. 6.
Figure 9:
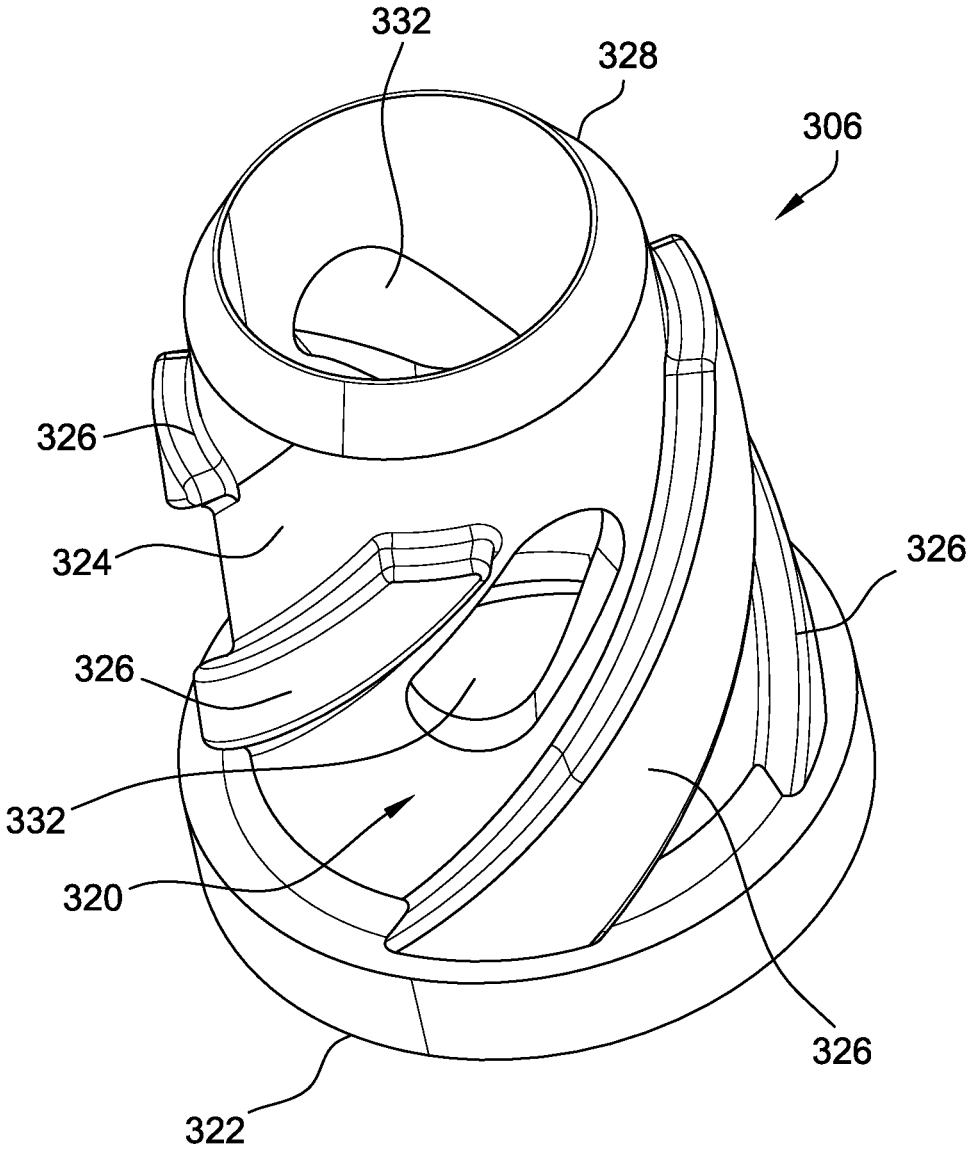
FIG. 9 is a perspective view of an exemplary embodiment of a first coupler for the coupler assembly shown in FIGS. 4-8.

As seen in the sectional views of FIGS. 7 and 9, the outer coupler 302 includes a hollow main body 310 and a shaft receiving end 312. The main body 310 includes an inner surface 314 having grooves 316 depending inwardly therefrom. Additionally, the main body 310 is conical in shape for most of its axial length. The conical-shaped main body 310 is axially tapered along an axial centerline of the main body 310 such that its diameter, and therefore its outer circumference also, gradually increases from the shaft receiving end 312 toward its open distal end 318 opposite the shaft receiving end 312. In other words, the inner diameter of inner surface 314 of the main body 310 at the distal end 318 is larger than the inner diameter of the inner surface 314 of the main body 310 adjacent the shaft receiving end 312, with the inner diameter uniformly decreasing from the end 318 to the end 312. The outer circumference of the main body 310 at the distal end 318 is also larger than the outer circumference of the main body 310 adjacent the shaft receiving end 312, with the outer circumference uniformly decreasing from the end 318 to the end 312.

By comparison, the inner and outer diameters of the main body of the coupler 200 shown in FIGS. 2 and 3 is constant for most of its axial length and as such the main body of the coupler 200 is not tapered or conical. The conical main body 310 of the coupler 302 has a sidewall that is sloped relative to the axial centerline of the coupler 302 as shown in FIGS. 7 and 8, whereas the sidewall of the main body of the coupler 200 in FIGS. 2 and 3 is not sloped and instead extends parallel to the axial centerline of the coupler 200.

The inner coupler 306 includes a hollow main body 320 and a shaft receiving end 322 in the illustrated example. The main body 320 includes an outer surface 324 having ribs 326 projecting outwardly therefrom. Additionally, the main body 320 is conical in shape for most of its axial length. The main body 320 is axially tapered such that its outer circumference gradually decreases from the shaft receiving end 322 toward its open distal end 328 opposite the shaft receiving end 322. In other words, the outer diameter of outer surface 324 of the main body 320 at the distal end 328 is smaller than the outer diameter of the outer surface 324 of the main body 320 adjacent the shaft receiving end 322, with the outer diameter uniformly decreasing from end 322 to 328. The inner circumference of the main body 320 at the distal end 328 is likewise smaller than the inner circumference of the main body 320 adjacent the shaft receiving end 322, with the inner circumference uniformly decreasing from end 322 to 328.

By comparison, the inner and outer diameters of the coupler 250 shown in FIGS. 2 and 3 is constant for most of its axial length and is not tapered or conical. The conical main body 320 of the coupler 306 has a sidewall that is sloped relative to the axial centerline of the coupler 306 as shown in FIGS. 7 and 8, whereas the sidewall of the main body of the coupler 250 in FIGS. 2 and 3 is not sloped and instead extends parallel to the axial centerline of the coupler 200.

Figure 6:
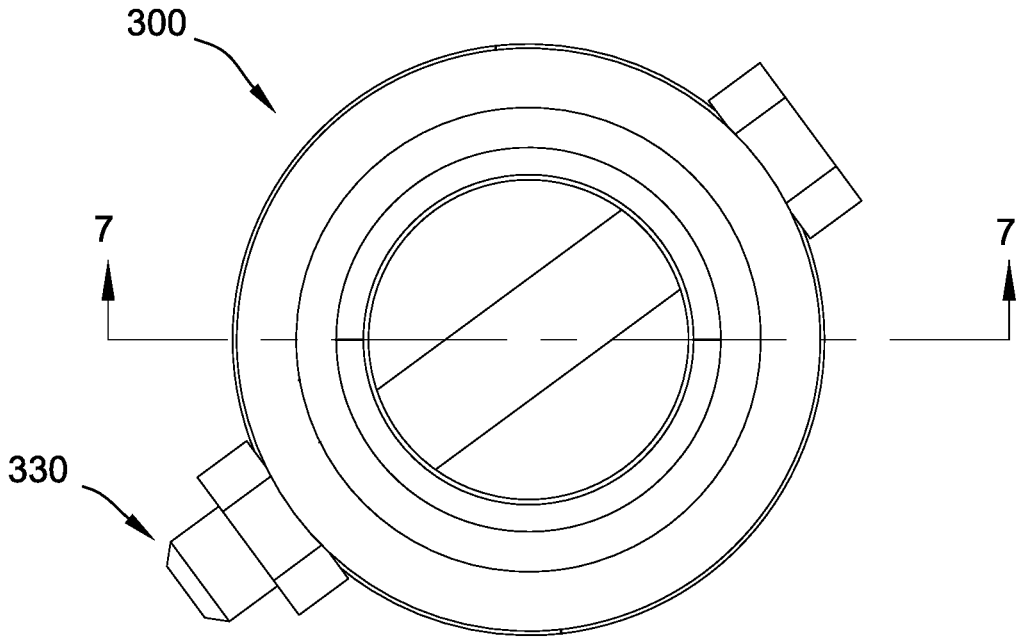
FIG. 6 is an end view of the coupler assembly shown in FIGS. 4 and 5.
Figure 8:
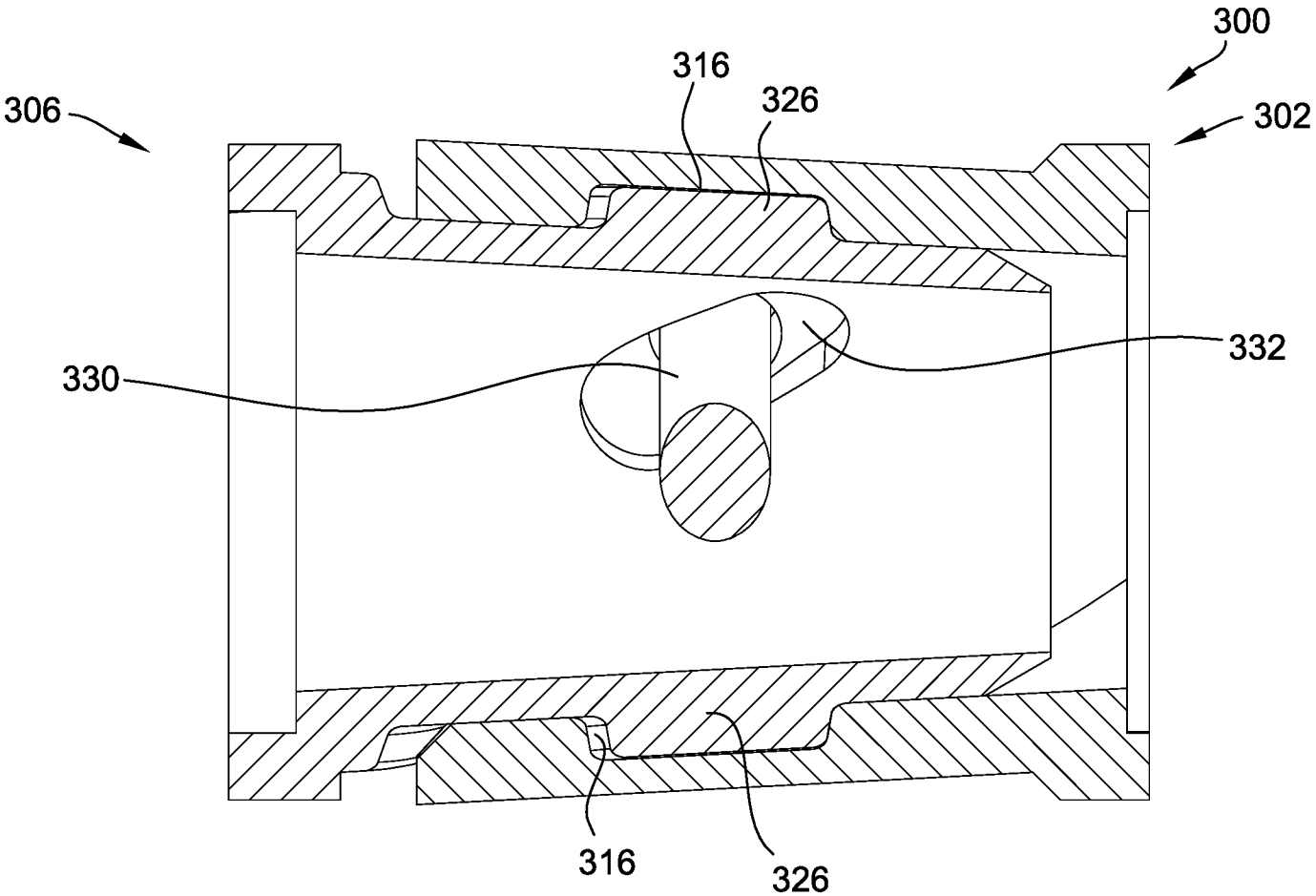
FIG. 8 is a second sectional view of the coupler assembly taken along line 8-8 in FIG. 7.

The anti-reverse rotation element 330 extends through and between a pair of openings 332 in the coupler 306 as shown in FIGS. 6-8. The openings 332 are elongated and oval-shaped and extend completely through the round sidewall of the main body 320 of the coupler 306. The oval-shaped openings 332 further extend angularly as shown in FIGS. 7 and 8. For the purposes herein, the angular extension of the openings 332 means that the openings 332 neither extend vertically nor horizontally in the sidewall of the conical main body 320. Since the main body has a round, tapered sidewall this means that the elongated openings 332 traverse a helical, spiral path of reducing diameter on the sidewall of the main body 320 in the coupler 306. The elongated openings 332 conveniently avoid a need to precisely align the openings 332 relative to the coupler 302 to complete the desired interconnection as well as provide a limited freedom of movement of the anti-reverse rotation element 330 relative to the elongated openings 332 in the coupler 306. The elongated openings 332 instead define guide paths for relative movement of the anti-reverse rotation element 330 in the openings 332 and/or relative movement of the openings 332 relative to the anti-reverse rotation element 330. Consequently, the coupler 306 including the openings 332 may move while the anti-reverse rotation element 330 remains stationary and vice versa.

As also seen in FIGS. 7 and 8, the grooves 316 in the coupler 302 are also oversized relative to the ribs 326 in the coupler 406 such that a gap is formed between one side of the ribs 326 and the adjacent side of the grooves 316. Such oversizing of the grooves permits a limited degree of relative movement between the ribs 326 and the grooves 316 when the couplers 302, 306 are mated to one another. Such limited freedom of movement, in turn, allows for limited, predetermined degree of relative rotation of the couplers 302, 306 to more easily facilitate installation of the anti-reverse rotation element 330.

Figure 10:
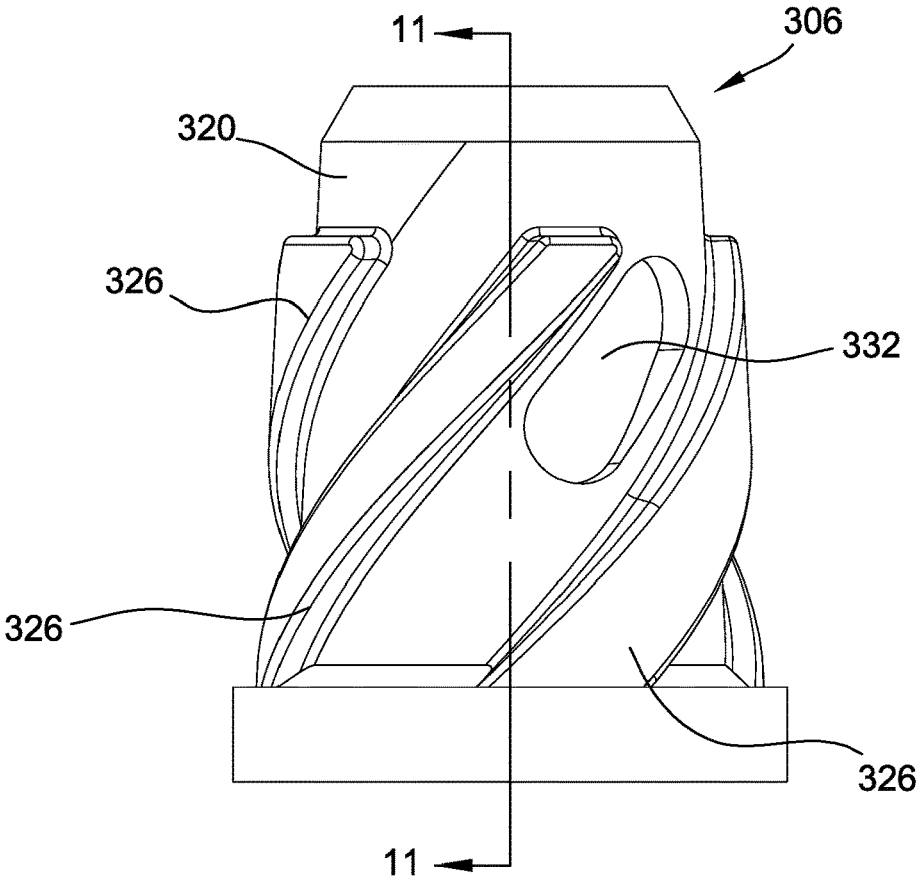
FIG. 10 is a side elevational view of the first coupler shown in FIG. 9.
Figure 11:
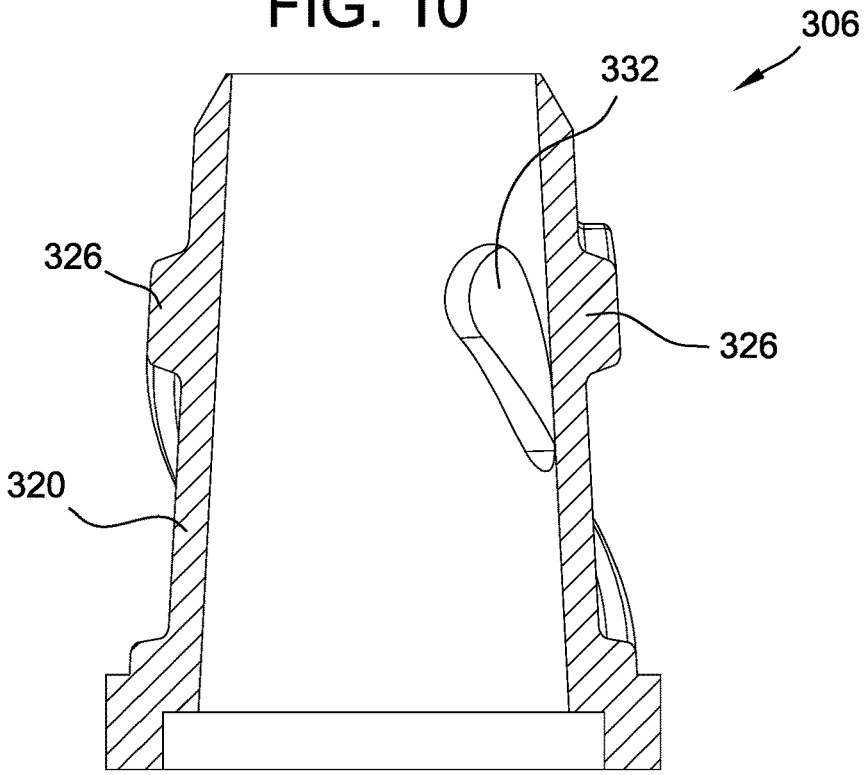
FIG. 11 is a sectional view of the first coupler taken along line 11-11 in FIG. 10.

FIGS. 9-11 are various views of an exemplary embodiment of the inner coupler 306. The shaft receiving end 322 is seen to have a first and larger outer diameter than the conical main body 320, and the distal end 328 is also seen be inwardly tapered at a leading edge thereof to facilitate a self-guided engagement with the outer coupler 302. The conical main body 320 extends between the shaft receiving end 322 and the tapered leading edge of the distal end 328.

The conical main body 320 is formed with a number of distinct, outwardly projecting spaced apart and helically extending ribs 326 projecting from outer surface 324. In the example shown, four helical ribs 326 are provided that are spaced about 90° apart from one another on the conical main body 320. The helical ribs 326 each extend spirally upon the outer surface of the main body 320 with a relatively large pitch (i.e., the end-to-end vertical rise of the helical ribs in FIG. 9 is large compared to the angular path of the helical ribs in the radial or circumferential direction). In the illustrated example, the pitch of the helical ribs 326 is such that, from the base of the pile receiving end 322 to the distal end of each rib 326, less than one complete turn of a helix is completed. For the context of the present description, a complete turn of a helix shall refer to a full 360° revolution on the circumference of the main body 320. As such, and in the exemplary coupler shown, each rib 326 completes a fractional turn (i.e., less than one turn or less than a 360° revolution) of a helix on the main body 320.

In the illustrated example, each rib 326 completes about a quarter turn (i.e., ¼ turn) of a helix on the main body, although more or less than about ¼ turn is possible in alternative embodiments. Because the main body 320 is conical, the helix defined by each rib 326 further has a reduced diameter from end to end of each rib 326. The distinct, helical ribs 326 extend as thread-like members on the outer surface of the main body 320, but are specifically distinguished from a more conventional threaded connection including small pitch helical threads that continuously define multiple turns of a helix. While a specific geometry and a specific number of helical ribs 326 is shown and described, it is appreciated that alternative numbers and/or alternative geometries of ribs 326 is possible in another embodiment.

FIGS. 9-11 further show the pair of elongated helical openings 332 extending opposite one another in the main body 320 and between adjacent helical ribs 326. The openings 332 are located at about 180° positions on the conical main body 320 and as seen in FIG. 9 are angled in different directions on each side of the main body 320. The openings 332 also have a longitudinal length between the axial ends thereof that is less than a longitudinal length between the axial ends of the helical ribs 326.

Figure 12:
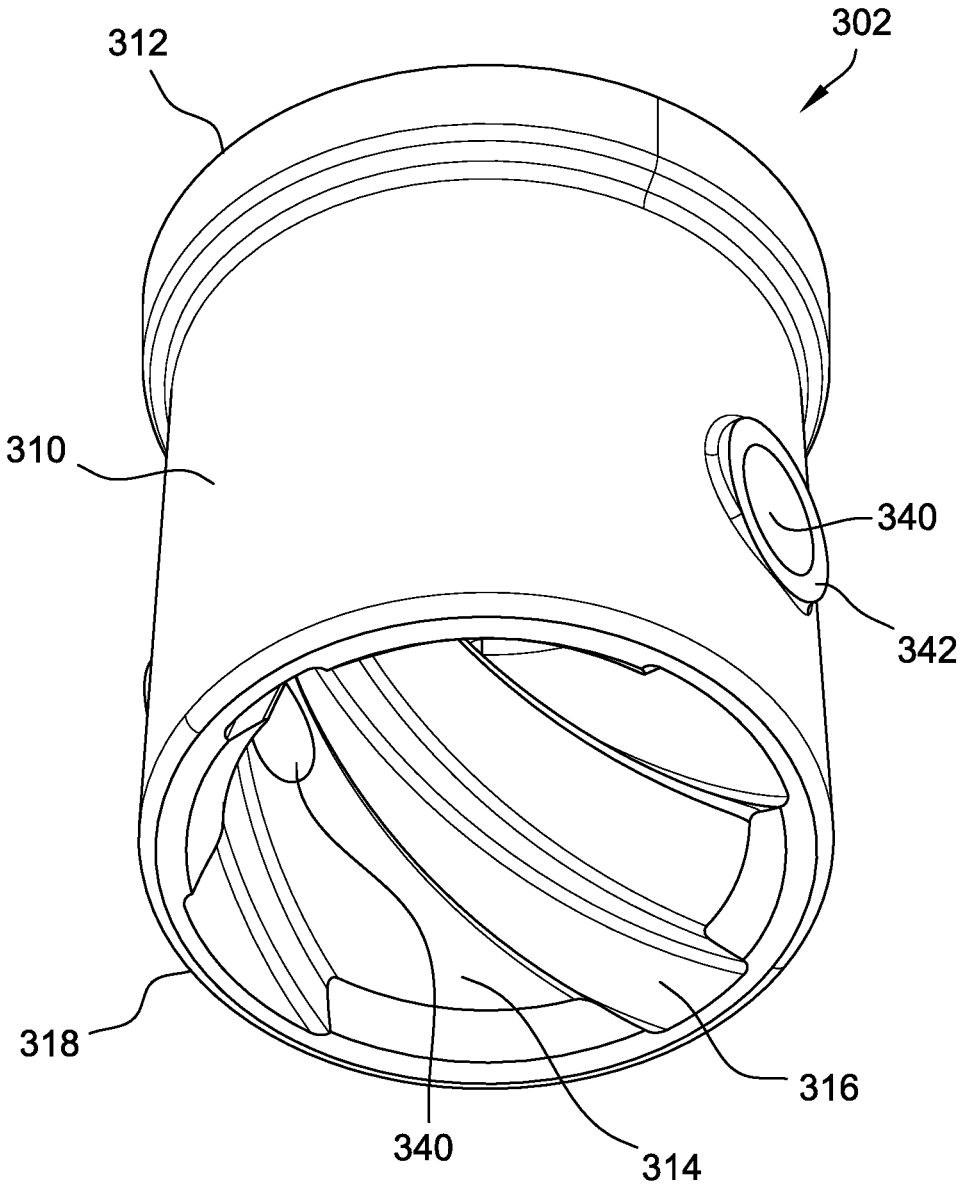
FIG. 12 is a perspective view of an exemplary embodiment of a second coupler for the coupler assembly shown in FIGS. 4-8.
Figure 13:
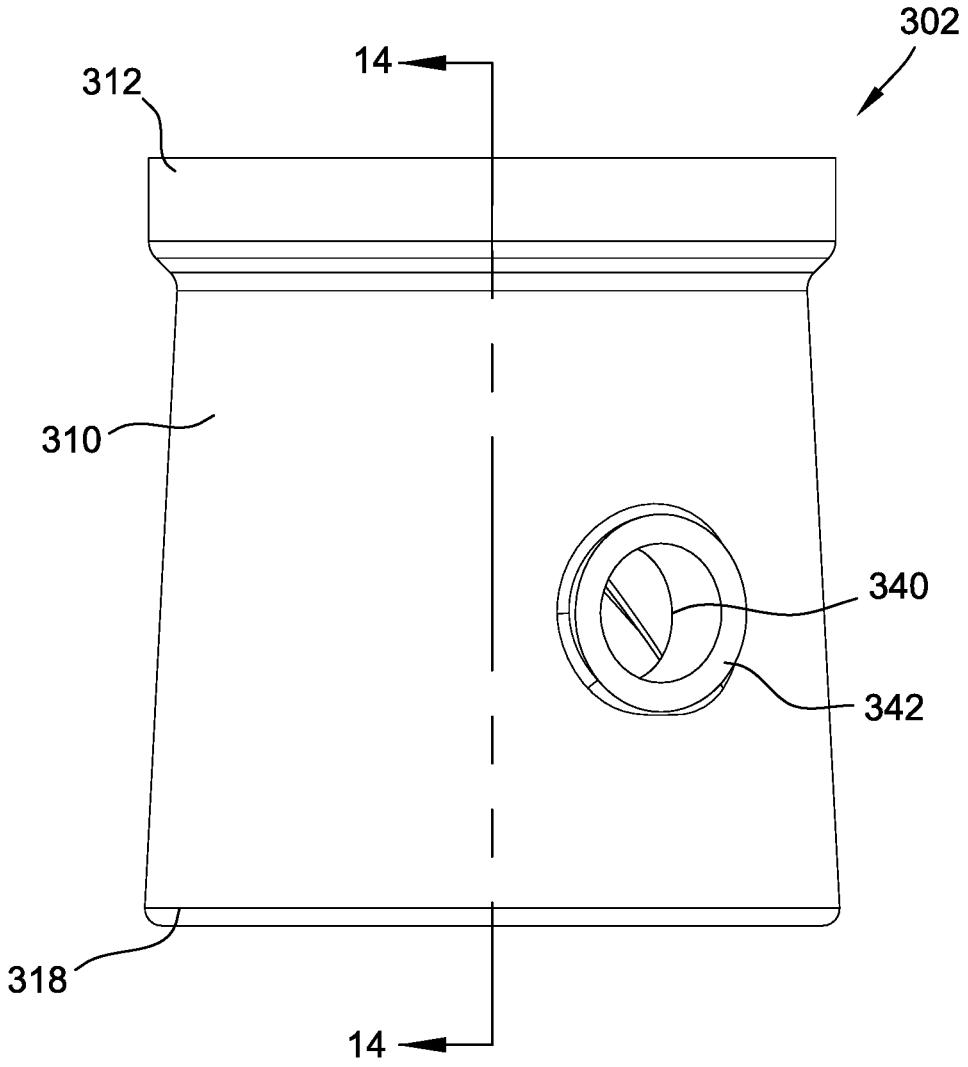
FIG. 13 is a side elevational view of the second coupler shown in FIG. 12.
Figure 14:
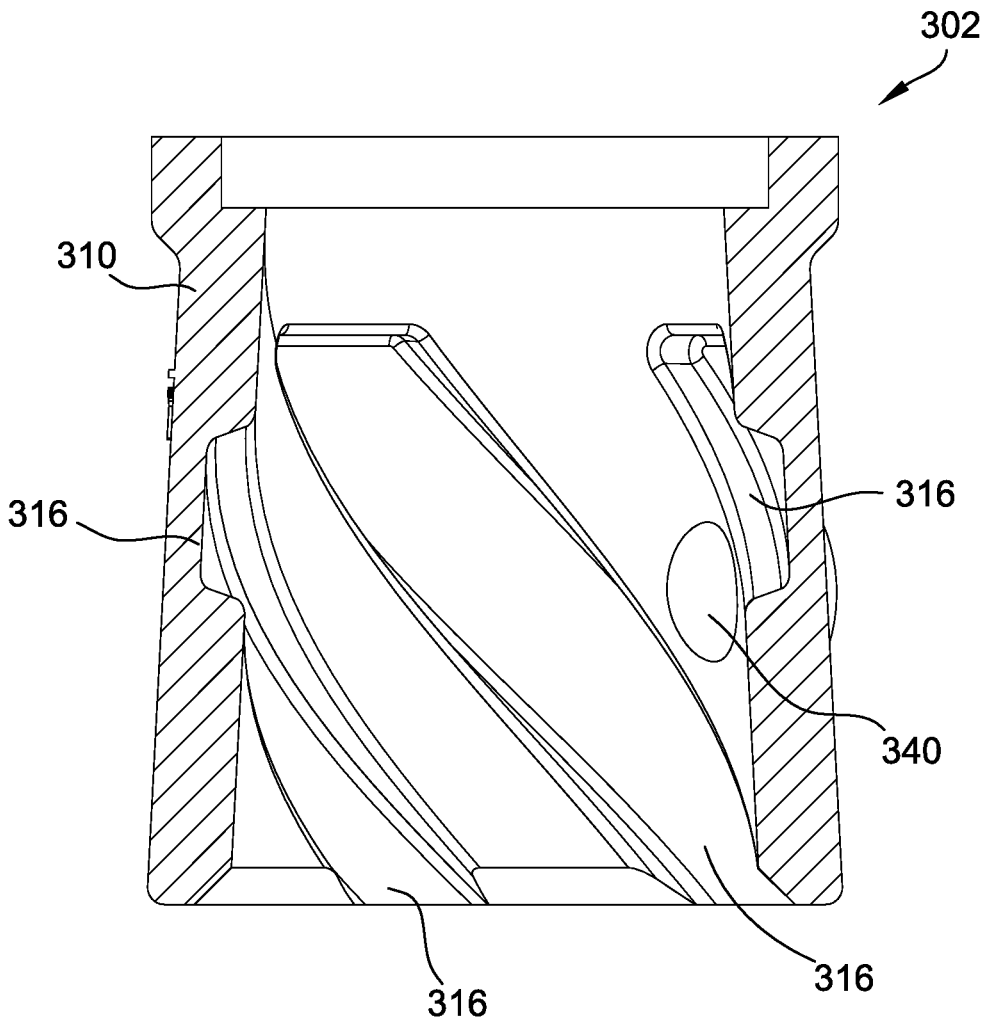
FIG. 14 is a sectional view of the second coupler taken along line 14-14 in FIG. 13.

FIGS. 12-14 are various views of the outer coupler 302 including the shaft receiving end 312, the conical main body 310 and the distal end 318. Helical grooves 316 are formed to depend from the inner surface 314 of the conical main body 310. Each helical groove 316 receives a respective one of the helical ribs 326 (FIGS. 9-11) when the coupler 302 is mated with the coupler 306 (FIGS. 7 and 8). The helical grooves 316 are shaped in a complementary manner to the helical ribs 326 but are slightly larger than the helical ribs so as to permit a limited degree of side-to-side movement of the ribs 326 in the grooves 316 as described above.

The main body 310 of the outer coupler 302 also includes a pair of openings 340 that receive the anti-reverse rotation element 330. When installed, the anti-reverse rotation element 330 extends through and between a pair of openings 332 in the coupler 306 and also through and between the openings 340 as shown in FIGS. 6-8. Unlike the openings 332 that are oval-shaped and extend as a helix, the openings 340 in the coupler 302 are circular and sized to snugly fit the outer diameter of the anti-reverse rotation element 330 that has a circular cross section. While the openings 332 define a guided path of movement for the anti-reverse rotation element 330 in use, the openings 340 in the coupler 302 do not. In other words, the openings 340, by design, are not elongated like the openings 340 and provide no path for relative movement between the anti-reverse rotation element 330 and the coupler 302. As a result, the coupler 302 and the anti-reverse rotation element 330 can move together but not separately. A reinforcing flange 342 of thicker material surrounds the openings 340 as shown to increase the structural strength around the openings 340.

The different shapes of the openings 332 and 340 in combination of couplers 306, 302 allows a limited degree of relative rotation of the couplers 302 and 306 in use, while providing a positive stop when the anti-reverse rotation element 330 reaches the upper end or lower end of the elongated openings 332 as best seen in FIGS. 9-11. When the anti-reverse rotation element 330 reaches the upper end of the elongated openings 332 in the coupler 306 any further relative rotation of the coupler 302 with respect to the coupler 306 is precluded when the coupler 302 is driven in the reverse direction. Likewise, and via the anti-reverse rotation element 330 and the elongated openings 332, when the anti-reverse rotation element 330 reaches the lower end of the elongated openings 332 any further relative rotation of the coupler 302 with respect to the coupler 306 is precluded when the coupler 302 is driven in the forward direction. The relative position of the anti-reverse rotation element 330 in the openings 332 and the relative positions of the ribs 326 in the grooves 316 may change as the coupler assembly is driven in forward and reverse directions to drive a pile further into the ground or to withdraw it from the ground, but the couplers 302 and 306 at all times remain positively interlocked by the anti-reverse rotation element 330 (which is fixed to the coupler 302 via the openings 340 that are not elongated) and as a result the couplers 302 and 306 will not separate from one another. Additional rotation beyond the limited degree permitted by the elongated openings 332 would be required for the helical ribs 326 to be withdrawn from the helical grooves 316 when driven in the reverse direction but such additional rotation is not possible by the stops provided and the fixed connection of the anti-reverse rotation element 330 and the openings 340, and consequently the couplers 302, 306 cannot be separated by reverse rotation or uplift force (either of which may be intentionally or unintentionally realized in the installation of the foundation support system. A structural integrity of the foundation support system is accordingly ensured in a manner that the couplers 200, 250 may not ensure in certain installations on certain construction sites.

In contemplated embodiments the anti-reverse rotation element 330 may be mechanically isolated in the assembly while the coupler assembly is subjected to forward and reverse rotation and/or uplift forces. In contemplated embodiments, rotational and uplift forces may be distributed solely through the ribs 326 and grooves 316 in the couplers while the anti-reverse rotation element 330 secures the axial interlock only. In other embodiments, however, rotational torque transmission may be distributed between a combination of the ribs 326, grooves 316, and the anti-reverse rotation element 330. That is, the anti-reverse rotation element 330 need not be mechanically isolated from torque transmission in certain contemplated embodiments.

Whether or not such mechanical isolation of the anti-reverse rotation element 330 is realized may depend on the relative locations of the elongated openings 332 and the stops provided relative to stops provided in the engagement of the ribs and grooves. In the exemplary embodiments depicted, for example, when the assembly 300 (FIG. 4) is driven in the forward direction, the distal ends of the ribs 326 (FIGS. 9 and 10) in the coupler 306 may be fully engaged to the complementary distal ends of the grooves 316 (FIG. 19) in the coupler 302 before the anti-reverse rotation element 330 reaches the lower end of the elongated openings 332 in the coupler 306. In this arrangement, no forward torque is carried by the anti-reverse rotation element and the entirety of the forward torque transmission to drive the assembly 300 into the ground is transmitted through the ribs and grooves.

In the reverse direction, torque would not be carried through the anti-reverse rotation element 330 when the anti-reverse rotation element has not completed the entire distance needed in the guide paths provided to reach the upper end of the elongated openings 332 in the coupler 306, or when another stop feature prevents the anti-reverse rotation element 330 from reaching the upper end of the elongate openings 332.

Because of such mechanical isolation of the anti-reverse rotation element, and because the force transmission in the forward direction would be greater in the forward direction than in the reverse direction, a single (i.e., only one) anti-reverse rotation element 330 is therefore sufficient in contemplated applications, and multiple anti-reverse rotation elements 330 are not required. A relatively simple and user friendly coupler assembly is therefore possible. In embodiments wherein the anti-reverse rotation element 330 may not be mechanically isolated from torsional forces or uplift forces in the forward or reverse directions, additional anti-reverse rotation elements 330 are possible in alternative embodiments to more effectively distribute rotational forces through the assembly when needed. Of course, multiple anti-reverse rotation elements 330 may be provided in various different embodiments that may or may not be individually mechanically isolated from torsional or uplift forces. Combinations of anti-reverse rotation elements 330 are likewise possible in the assembly 300 wherein some of the anti-reverse rotation elements 330 are mechanically isolated while others are not mechanically isolated.

In use, and referring back to FIG. 4, the shaft 308 which may be helical foundation support pile is driven into the ground in a known manner with the coupler 306 attached to a desired depth. The coupler 302 that is attached to the shaft 304, which may be an extension pile, is therefore inserted over the exposed coupler 306. The conically shaped couplers 302, 306 are rather easily engaged and the ribs 326 are received in the grooves 316. Specifically, the wider open end of the conical-shaped coupler 302 is inserted over the narrower end of the conical-shaped coupler 302 and the couplers are engaged in a generally self-aligning manner to one another for convenience of the installers. The tapered engagement surfaces of the conical couplers also beneficially minimize, if not eliminate, so called "play" in the coupler assembly that is common in conventional coupler assemblies for foundation support systems.

Once the couplers are engaged, the anti-reverse rotation element 330 is easily inserted through the openings 340 and 332 in the couplers described. The openings 340 and 332 need not be precisely aligned as the elongated openings 332 permit installation of the anti-reverse rotation element 330 within a range of relative rotational positions of the couplers 306 and 302. Once the anti-reverse rotation element 330 is secured (via a nut in the illustrated example), the shaft 304 can be rotated in the forward direction to drive the interconnected shafts 304 and 308 into the ground. More than one coupler assembly 300 may be provided to interconnect another extension pile as needed. If reverse rotation of any shaft is needed during the installation the anti-reverse rotation element 330 and openings 332, 340 described will allow a small, predetermined degree of rotation of the coupler 302 relative to the coupler 306 and thereafter preclude further relative rotation while ensuring that the couplers cannot be separated. Completion of a foundation support assembly may include attachment of a support plate, support bracket, lifting assembly, etc. to support the foundation in the desired manner at the top of the pile adjacent the foundation.

Figure 4:
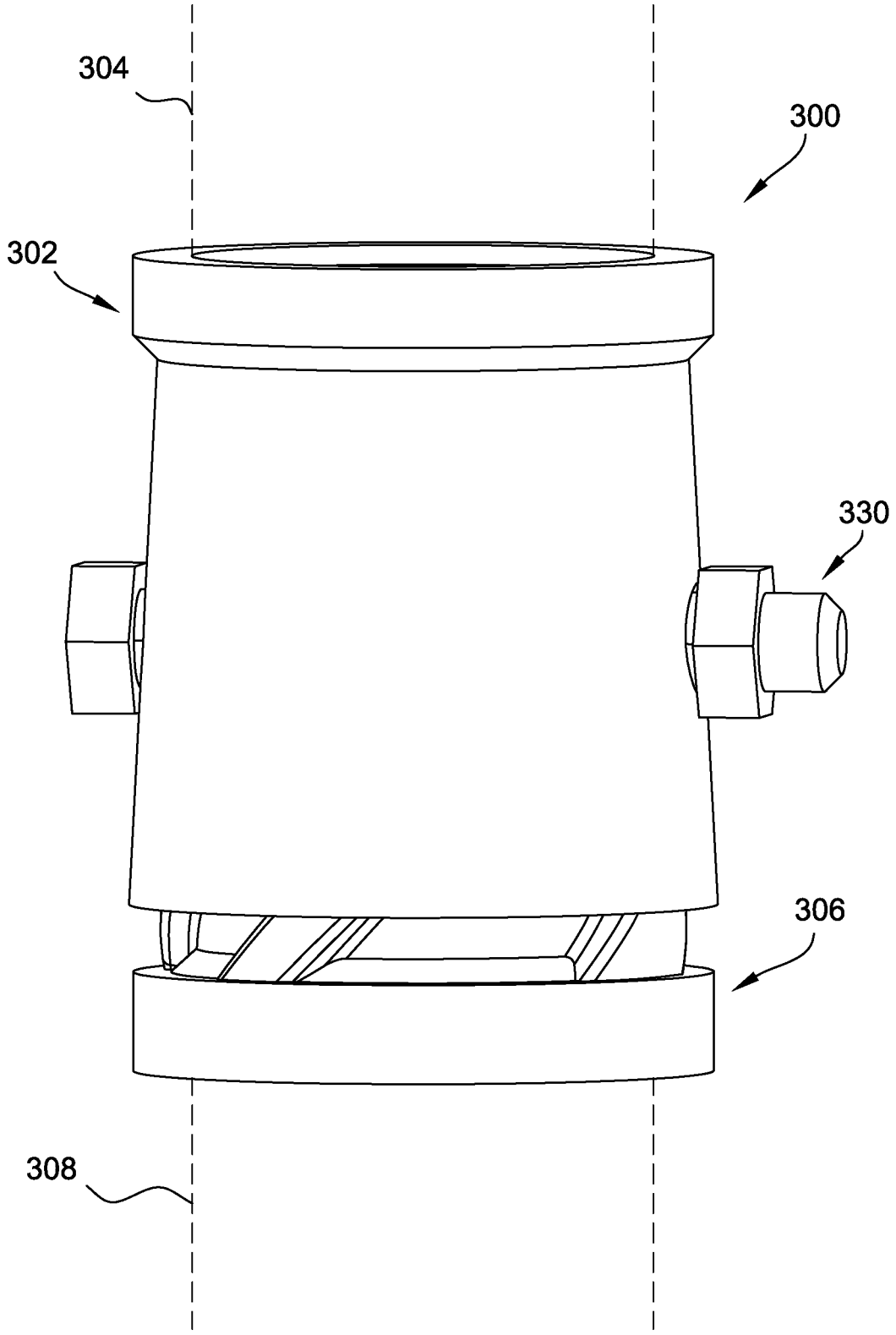
FIG. 4 is a front elevational view of a coupler assembly for the foundation support system shown in FIG. 1 in accordance with an exemplary embodiment of the present invention.
Figure 5:
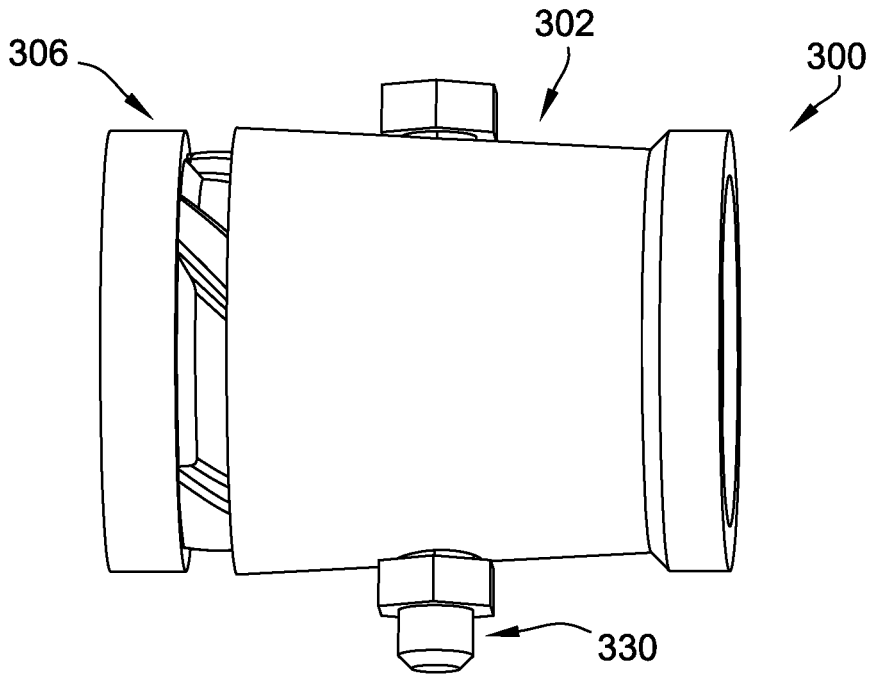
FIG. 5 is a side view of the coupler assembly shown in FIG. 4.

While one exemplary implementation of the couplers 302, 306 are described, variations are of course possible while still realizing similar benefits and advantages. For example, while FIG. 4 shows the coupler 306 on the lower shaft 308 and the coupler 302 on the upper shaft 304, the coupler 302 could instead be provided on the lower shaft 308 while the coupler 306 could be provided on the upper shaft 304 without impacting the functional benefits and advantages of the engaged couplers 302, 306 described above.

In another contemplated variation to the assembly 300 described above, the elongated openings 332 could be provided in the coupler 302 instead of the coupler 306 while the openings 340 could be provided in the coupler 306 instead of the coupler 302. Again, the functional benefits of the engaged couplers and the advantages of the invention would not change in such an arrangement.

In another contemplated variation to the assembly 300 described above, the orientation of ribs and grooves in the couplers 302, 306 could be reversed in another variation of the invention. As such, the ribs 326 could be provided on the inner surface of the coupler 302, while the grooves 316 could be provided on the outer surface of the coupler 306 to realize the same functional benefits and advantages to those described above. Likewise, combinations of ribs and grooves in each coupler 302, 306 are possible while realizing the same benefits and advantages.

In another contemplated variation to the assembly 300 described above, the openings 332 and 340 that provide ease of assembly and the limited, guided path of relative movement of the anti-reverse rotation element 330 with respect to one of the couplers 302, 306 as described above may be implemented in couplers having ribs and grooves that are not helical to provide beneficial, limited degrees of relative rotation of the couplers in reverse and/or to ensure that uplift forces will not separate the couplers in the axial direction. Such contemplated variations would likewise eliminate the use of the spring 270 (FIGS. 2 and 3) and potential problems of the spring being overstressed in manner that compromises the integrity of the foundation support system.

In another contemplated variation to the assembly 300 described above, combinations of the variations described above could be implemented in the assembly without affecting the resultant benefits and advantages of the invention.

Anti-reverse rotation elements 330 besides threaded bolts are contemplated to realize similar benefits to those described above in further variants of the assembly 300. For example, cotter pins and keys and the like may be used in lieu of a threaded bolt and nut as described and illustrated, while still other types of fasteners are possible as well to realize the desired connections with similar effect and advantage. Also, instead of a single anti-reverse rotation element 330 extending completely across and between the mated couplers as shown in FIG. 6, separate anti-reverse rotation elements 330 (whether or not bolts) are possible which complete a connection on the respective sides of the assembly.

In certain contemplated embodiments, the anti-reverse rotation element described herein may be used in combination with a spring 270 (FIGS. 2 and 3) to provide snap-lock functionality with assurance (provided by the anti-reverse rotation elements 330 described herein) that the spring 270 will not be overstressed in manner that compromises structural integrity of the foundation support system.

It should be appreciated that the couplers 302, 306 described may be more or less universally used to connect shafts of different size and circumference as well as different cross-sectional shapes. For example, the couplers described above may be used to rotationally interlock shafts have round or circular cross-sectional shapes, square or rectangular cross-sectional shapes, or hexagonal cross-sectional shapes as non-limiting examples. The couplers may also be utilized to interconnect shafts having different size and circumferential dimensions and/or shafts having different cross-sectional shapes as desired or as needed.

The benefits and advantages of the inventive concepts described herein are now believed to have been amply illustrated in relation to the exemplary embodiments disclosed.

An embodiment of a foundation support system has been disclosed that includes a coupled shaft assembly. The coupled shaft assembly includes an inner coupler extending on a first end of a first hollow foundation support shaft, and an outer coupler extending on a second end of a second hollow foundation support shaft. The inner coupler is formed with a first main body having a first sidewall and at least a first opening formed through the first sidewall. The outer coupler is formed with a second main body having a second sidewall and at least a second opening formed through the second sidewall. One of the first opening and the second opening is elongated and the other of the first opening and the second opening is not elongated, and an anti-reverse rotation element is received through the first opening and the second opening when the second main body is received in the first main body. The elongated opening provides a guide path for a limited relative movement of the anti-reverse rotation element relative to one of the first or second main body when one of the inner coupler or the outer coupler is subjected to a reverse rotation or an uplift force.

Optionally, the guide path of the elongated opening may extend angularly in the first or second sidewall. The guide path of the elongated opening may extend helically in the first or second sidewall. Each of the first main body and the second main body may be conical. Each of the first main body and the second main body may be round.

As further options, one of the first main body and the second main body may be formed with at least one rib, and the other of the first man body and the second main body may be formed with at least one groove, wherein when the at least one rib is received in the at least one groove a torque transmitting connection is established between the first man body and the second main body. The anti-reverse rotation element may be mechanically isolated by the at least one rib and the at least one groove when the coupled shaft assembly is subjected to torque in a forward direction or a reverse direction. The at least one rib may extend helically on one of the first man body and the second main body, and the at least one groove may extend helically on the other of the first man body and the second main body. The at least one rib may define only a fractional turn of a helix on one of the first main body and the second main body. The at least one rib may define about ¼ turn of a helix on one of the first main body and the second main body. The at least one groove may be oversized relative to the at least one rib, thereby permitting a limited degree of side-to-side motion of the at least one rib in the at least one groove. The at least one rib may be formed in the inner coupler. The at least one rib may include four ribs and the at least one groove may include four grooves. The four ribs and the four grooves may be equally spaced from another on the first main body or the second main body.

Additionally, the first opening and the second opening may be self-aligning when the at least one rib is received in the at least one groove.

The at least one rib may include first and second ribs spaced from another, and the elongated opening may be located between the first and second rib. The at least one rib may also have a first longitudinal length and the elongated opening may have a second longitudinal length, wherein the second longitudinal length is less than the first longitudinal length. Each of the first and second longitudinal length may extend parallel to one another on the first man body or the second main body. Each of the first and second longitudinal length may extend spirally on the first man body or the second main body.

As still other options, the anti-reverse rotation element may have a circular cross section. The anti-reverse rotation element may be a bolt. One of the first opening and the second opening may be oval-shaped and the other of the one of the first opening and the second opening may be circular. The opening that is not elongated may snugly fit the anti-reverse rotation element in a manner that precludes a relative movement of the anti-reverse rotation element relative to the first or second main body when one of the inner coupler or the outer coupler is subjected to a reverse rotation or an uplift force. The at least a first opening may include a pair of first openings opposite one another in the first main body and the at least a second opening may include a pair of second openings opposite one another in the second main body, wherein the anti-reverse rotation element is extended through and between each of the pair of first openings and each of the pair of second openings.

The pair of first openings may be self-aligning with the pair of second openings when the first main body is engaged to the second main body. The foundation support may further include a cap, a plate, or a lift bracket to support a building foundation in combination with the coupled shaft assembly. The foundation support system may be provided in combination with a grout or cementitious material to enhance a structural strength and capacity of the coupled shaft assembly in the installed foundation support system. The first and second hollow foundation support shafts may be steel shafts. One of the first and second hollow foundation support shafts may include a helical auger. At least one of the inner and outer couplers may be separately fabricated from the first or second hollow foundation support shaft.

Another embodiment of a foundation support system has also been disclosed. The foundation support system includes a coupled shaft assembly including an inner coupler extending on a first end of a first hollow foundation support shaft, and an outer coupler extending on a second end of a second hollow foundation support shaft. The coupled shaft assembly further includes an anti-reverse rotation element securing the outer coupler to the inner coupler when the inner coupler is received in the outer coupler. The anti-reverse rotation element is mounted stationary to one of the inner coupler and the outer coupler, and is movable relative to the other of the inner coupler and the outer coupler along a guide path formed in the other of the inner coupler and the outer coupler when one of the inner coupler or the outer coupler is subjected to a reverse rotation or an uplift force.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A foundation support system comprising:

a coupled shaft assembly comprising:

an inner coupler extending on a first end of a first hollow foundation support shaft, the inner coupler formed with a first main body having a first sidewall and at least a first opening formed through the first sidewall;

an outer coupler extending on a second end of a second hollow foundation support shaft, the outer coupler formed with a second main body having a second sidewall and at least a second opening formed through the second sidewall;

wherein one of the first opening and the second opening is elongated and wherein the other of the first opening and the second opening is not elongated; and an anti-reverse rotation element received through the first opening and the second opening when the first main body is received in the second main body;

wherein the elongated opening provides a guide path for a limited relative movement of the anti-reverse rotation element relative to one of the first or second main body when one of the inner coupler or the outer coupler is subjected to a reverse rotation or an uplift force; and wherein the guide path of the elongated opening extends helically in the first or second sidewall.

2. The foundation support system of claim 1, wherein each of the first main body and the second main body are conical.

3. The foundation support system of claim 1, wherein each of the first main body and the second main body are round.

4. The foundation support system of claim 1;

wherein one of the first main body and the second main body is formed with at least one rib;

wherein the other of the first main body and the second main body is formed with at least one groove; and wherein when the at least one rib is received in the at least one groove a torque transmitting connection is established between the first main body and the second main body.

5. The foundation support system of claim 4, wherein the anti-reverse rotation element is mechanically isolated by the at least one rib and the at least one groove when the coupled shaft assembly is subjected to torque in a forward direction or a reverse direction.

6. The foundation support system of claim 4, wherein the at least one rib is formed in the inner coupler.

7. The foundation support system of claim 4, wherein the at least one rib comprises four ribs and the at least one groove comprises four grooves.

8. The foundation support system of claim 7, wherein the four ribs and the four grooves are equally spaced from one another on the first main body or the second main body.

9. The foundation support system of claim 4, wherein the first opening and the second opening are self-aligning when the at least one rib is received in the at least one groove.

10. The foundation support system of claim 4;

wherein the at least one rib includes first and second ribs spaced from one another; and wherein the elongated opening is located between the first and second rib.

11. The foundation support system of claim 4;

wherein the at least one rib has a first longitudinal length;

wherein the elongated opening has a second longitudinal length; and wherein the second longitudinal length is less than the first longitudinal length.

12. The foundation support system of claim 11, wherein each of the first and second longitudinal length extend parallel to one another on the first main body or the second main body.

13. The foundation support system of claim 1, wherein the anti-reverse rotation element has a circular cross section.

14. The foundation support system of claim 1, wherein the anti-reverse rotation element is a bolt.

15. The foundation support system of claim 1, wherein one of the first opening and the second opening is oval-shaped and wherein the other of the one of the first opening and the second opening is circular.

16. The foundation support system of claim 1, wherein the opening that is not elongated snugly fits the anti-reverse rotation element in a manner that precludes a relative movement of the anti-reverse rotation element relative to the first or second main body when one of the inner coupler or the outer coupler is subjected to a reverse rotation or an uplift force.

17. The foundation support system of claim 1;

wherein the at least a first opening comprises a pair of first openings opposite one another in the first main body;

wherein the at least a second opening comprises a pair of second openings opposite one another in the second main body; and wherein the anti-reverse rotation element is extended through and between each of the pair of first openings and each of the pair of second openings.

18. The foundation support system of claim 17, wherein the pair of first openings are self-aligning with the pair of second openings when the first main body is engaged to the second main body.

19. The foundation support system of claim 1, further comprising a cap, a plate, or a lift bracket to support a building foundation in combination with the coupled shaft assembly.

20. The foundation support system of claim 1, in combination with a grout or cementitious material to enhance a structural strength and capacity of the coupled shaft assembly in the installed foundation support system.

21. The foundation support system of claim 1, wherein the first and second hollow foundation support shafts are steel shafts.

22. The foundation support system of claim 1, wherein one of the first and second hollow foundation support shafts includes a helical auger.

23. The foundation support system of claim 1, wherein at least one of the inner and outer couplers is separately fabricated from the first or second hollow foundation support shaft.

24. A foundation support system comprising:

a coupled shaft assembly comprising:

an inner coupler extending on a first end of a first hollow foundation support shaft, the inner coupler formed with a first main body having a first sidewall and at least a first opening formed through the first sidewall;

an outer coupler extending on a second end of a second hollow foundation support shaft, the outer coupler formed with a second main body having a second sidewall and at least a second opening formed through the second sidewall;

wherein one of the first opening and the second opening is elongated and wherein the other of the first opening and the second opening is not elongated; and an anti-reverse rotation element received through the first opening and the second opening when the first main body is received in the first second main body;

wherein the elongated opening provides a guide path for a limited relative movement of the anti-reverse rotation element relative to one of the first or second main body when one of the inner coupler or the outer coupler is subjected to a reverse rotation or an uplift force;

wherein one of the first main body and the second main body is formed with at least one rib;

wherein the other of the first main body and the second main body is formed with at least one groove; and wherein when the at least one rib is received in the at least one groove a torque transmitting connection is established between the first main body and the second main body;

wherein the at least one rib extends helically on one of the first main body and the second main body; and wherein the at least one groove extends helically on the other of the first main body and the second main body.

25. The foundation support system of claim 24, wherein the at least one rib defines only a fractional turn of a helix on one of the first main body and the second main body.

26. The foundation support system of claim 25, wherein the at least one rib defines about ¼ turn of a helix on one of the first main body and the second main body.

27. The foundation support system of claim 24, wherein the guide path of the elongated opening extends helically in the first or second sidewall.

28. A foundation support system comprising:

a coupled shaft assembly comprising:

an inner coupler extending on a first end of a first hollow foundation support shaft, the inner coupler formed with a first main body having a first sidewall and at least a first opening formed through the first sidewall;

an outer coupler extending on a second end of a second hollow foundation support shaft, the outer coupler formed with a second main body having a second sidewall and at least a second opening formed through the second sidewall;

wherein one of the first opening and the second opening is elongated and wherein the other of the first opening and the second opening is not elongated; and an anti-reverse rotation element received through the first opening and the second opening when the first main body is received in the second main body;

wherein the elongated opening provides a guide path for a limited relative movement of the anti-reverse rotation element relative to one of the first or second main body when one of the inner coupler or the outer coupler is subjected to a reverse rotation or an uplift force;

wherein one of the first main body and the second main body is formed with at least one rib;

wherein the other of the first main body and the second main body is formed with at least one groove; and wherein when the at least one rib is received in the at least one groove a torque transmitting connection is established between the first main body and the second main body;

wherein the at least one groove is oversized relative to the at least one rib, thereby permitting a limited degree of side-to-side motion of the at least one rib in the at least one groove.

29. The foundation support system of claim 28, wherein the guide path of the elongated opening extends helically in the first or second sidewall.

30. The foundation support system of claim 28, wherein the at least one rib extends helically on one of the first main body and the second main body; and wherein the at least one groove extends helically on the other of the first main body and the second main body.

31. A foundation support system comprising:

a coupled shaft assembly comprising:

an inner coupler extending on a first end of a first hollow foundation support shaft, the inner coupler formed with a first main body having a first sidewall and at least a first opening formed through the first sidewall;

an outer coupler extending on a second end of a second hollow foundation support shaft, the outer coupler formed with a second main body having a second sidewall and at least a second opening formed through the second sidewall;

wherein one of the first opening and the second opening is elongated and wherein the other of the first opening and the second opening is not elongated; and an anti-reverse rotation element received through the first opening and the second opening when the first main body is received in the second main body;

wherein the elongated opening provides a guide path for a limited relative movement of the anti-reverse rotation element relative to one of the first or second main body when one of the inner coupler or the outer coupler is subjected to a reverse rotation or an uplift force;

wherein one of the first main body and the second main body is formed with at least one rib;

wherein the other of the first main body and the second main body is formed with at least one groove; and wherein when the at least one rib is received in the at least one groove a torque transmitting connection is established between the first main body and the second main body;

wherein the at least one rib has a first longitudinal length;

wherein the elongated opening has a second longitudinal length; and wherein the second longitudinal length is less than the first longitudinal length;

wherein each of the first and second longitudinal length extend spirally on the first main body or the second main body.

32. The foundation support system of claim 31, wherein the guide path of the elongated opening extends helically in the first or second sidewall.

* * * * *